US010576313B2

(12) United States Patent
Shigematsu et al.

(10) Patent No.: US 10,576,313 B2
(45) Date of Patent: Mar. 3, 2020

(54) DETACHABLE CONNECTOR

(71) Applicant: SHIGEMATSU WORKS CO., LTD., Tokyo (JP)

(72) Inventors: Nobuo Shigematsu, Tokyo (JP); Kenichi Ono, Saitama (JP); Osamu Zaitsu, Saitama (JP)

(73) Assignee: SHIGEMATSU WORKS CO., LTD., Tokyo (JP)

( * ) Notice: Subject to any disclaimer, the term of this patent is extended or adjusted under 35 U.S.C. 154(b) by 0 days.

(21) Appl. No.: 15/300,050

(22) PCT Filed: Mar. 9, 2016

(86) PCT No.: PCT/JP2016/057441
§ 371 (c)(1),
(2) Date: Sep. 28, 2016

(87) PCT Pub. No.: WO2017/154150
PCT Pub. Date: Sep. 14, 2017

(65) Prior Publication Data

US 2018/0250536 A1 Sep. 6, 2018

(51) Int. Cl.
*A62B 18/08* (2006.01)
*A62B 7/10* (2006.01)
(Continued)

(52) U.S. Cl.
CPC ..... *A62B 18/08* (2013.01); *A62B 7/10* (2013.01); *A62B 9/04* (2013.01); *A62B 19/00* (2013.01)

(58) Field of Classification Search
CPC ..... A62B 9/00; A62B 9/02–027; A62B 7/00; A62B 7/04; A62B 7/014; A62B 18/00;
(Continued)

(56) References Cited

U.S. PATENT DOCUMENTS 4,850,346 A 7/1989 Michel et al.
6,860,267 B2 3/2005 Capon et al.
(Continued)

FOREIGN PATENT DOCUMENTS

CN 101052441 B 1/2011
EP 2 496 312 A2 9/2012
(Continued)

OTHER PUBLICATIONS

International search report issued in corresponding application PCT/JP2016/057441, completed May 23, 2016 and dated May 31, 2016.
(Continued)

*Primary Examiner* — Samchuan C Yao
*Assistant Examiner* — Ned T Heffner
(74) *Attorney, Agent, or Firm* — Merchant & Goould, P.C.

(57) ABSTRACT

[Object of the Invention] An object of the present invention is to provide a detachable connector between a face piece and a filter of a breathing apparatus comprising a bayonet connection mechanism for connecting a pair of members by pushing and twisting operation, wherein detaching of the filter from the face piece by accident or user error is effectively prevented.

[Disclosure of the Invention] A detachable connector between a face piece and a filter of a breathing apparatus is provided with a bayonet connection mechanism for connecting a pair of members by pushing and twisting operation, and a lock mechanism for locking a connection between the pair of members by fitting a pin in a hole provided in an elastic member, wherein connecting motion of the bayonet connection mechanism synchronizes with locking motion of the lock mechanism so that connection of the filter and locking of the connection are carried out
(Continued)

simultaneously when the filter is connected to the face piece, while unlocking motion of the lock mechanism precedes disconnecting motion of the bayonet connection mechanism so that unlocking of the connection precedes disconnection of the filter when the filter is disconnected from the face piece.

4 Claims, 5 Drawing Sheets

(51) Int. Cl.
*A62B 9/04* (2006.01)
*A62B 19/00* (2006.01)

(58) Field of Classification Search
CPC ..... A62B 18/10; A61M 16/00; A61M 16/06–0694; A61M 16/20–209; B63C 11/12; B63C 11/18
USPC ..... 215/216, 221; 220/236
See application file for complete search history.

(56) References Cited

U.S. PATENT DOCUMENTS

| | | | | |
|---|---|---|---|---|
| 7,320,722 | B2 | 1/2008 | Mittelstadt et al. | |
| 2005/0145249 | A1* | 7/2005 | Solyntjes ..... | A62B 23/02 128/205.25 |
| 2006/0090754 | A1 | 5/2006 | Mittelstadt et al. | |
| 2011/0064537 | A1 | 3/2011 | Wrigley | |
| 2013/0125896 | A1 | 5/2013 | Dwyer et al. | |
| 2013/0298775 | A1 | 11/2013 | Fiet et al. | |
| 2014/0144110 | A1 | 5/2014 | Wood et al. | |
| 2015/0314147 | A1 | 11/2015 | Fleming et al. | |
| 2016/0001107 | A1 | 1/2016 | Simmonds | |

FOREIGN PATENT DOCUMENTS

| | | | |
|---|---|---|---|
| JP | 9-192246 | A | 7/1997 |
| JP | 11-99214 | A | 4/1999 |
| JP | 2005-270492 | A | 10/2005 |
| JP | 2014-524280 | A | 9/2014 |
| JP | 2014-533553 | A | 12/2014 |
| KR | 10-2009-0053528 | | 9/2009 |
| KR | 20-2012-0000038 | | 9/2012 |
| TW | 201607580 | A | 3/2016 |
| WO | 2009/066833 | A1 | 5/2009 |
| WO | 2011/051715 | A2 | 5/2011 |
| WO | 2013/019764 | | 2/2013 |

OTHER PUBLICATIONS

Written Opinion issued in corresponding application PCT/JP2016/057441, completed May 23, 2016 and dated May 31, 2016.
Extended European Search report issued in co-pending application 16745599.7, completed Mar. 10, 2017 and dated Mar. 21, 2017.
Office Action issued in co-pending Taiwanese application, dated Jan. 19, 2017 and dated Jan. 23, 2017 (no translation available; submitted for certification).
Office Action issued in corresponding Korean patent application 10-2016-7023612 dated Dec. 6, 2017.
English language summary of Korean office action dated Dec. 6, 2017.
Search Report contained in Office Action in copending Chinese application 201680000870.6 dated Oct. 8, 2019.

* cited by examiner

DETACHABLE CONNECTOR

This is a National Phase Application in the United States of International Patent Application No. PCT/JP2016/057441 filed Mar. 9, 2016. The entire disclosures of the above patent applications are hereby incorporated by reference.

TECHNICAL FIELD

The present invention relates to a detachable connector between a face piece and a filter of a breathing apparatus.

BACKGROUND ART

Patent document No. 1 discloses a detachable connector between a face piece and a filter of a breathing apparatus comprising a bayonet connection mechanism for connecting a pair of members by pushing and twisting operation.

The bayonet connection mechanism comprises a male side member provided with a lug, a female side member provided with a lug or an L-shaped slot and a spring, wherein pushing force is applied to the male side member so as to push the lug of the male side member into the L-shaped slot of the female side member or to the rear near one end of the lug of the female side member, twisting force is applied to the male side member so as to twist the lug of the male side member along the slot or the lug of the female side member, and then the pushing force and the twisting force are released from the male side member so as to force the lug of the male side member against a side surface of the L-shaped slot or a rear surface of the lug of the female side member by means of the biasing force of the spring, thereby connecting the male side member with the female side member. The L-shaped slot of the female side member is provided with a projection near an entrance and the lug of the female side member is provided with a projection near aforesaid one end. The projection extends in the direction of the pushing force applied to the male side member. Thus, the lug of the male side member cannot be released from engagement with the slot or the lug of the female side member by simple twisting of the male side member in the releasing direction.

PATENT DOCUMENT

Patent Document No. 1: Japanese Patent Laid-Open No. 2014-533553

DISCLOSURE OF INVENTION

Problem to Be Solved

The male side member can be pushed into the female side member and twisted in the releasing direction by accident or error of a user of the breathing apparatus.

An object of the present invention is to provide a detachable connector between a face piece and a filter of a breathing apparatus comprising a bayonet connection mechanism for connecting a pair of members by pushing and twisting operation, wherein detaching of the filter from the face piece by accident or user error is effectively prevented.

Means for Achieving the Object

In accordance with the present invention, there is provided a detachable connector between a face piece and a filter of a breathing apparatus comprising a bayonet connection mechanism for connecting a pair of members by pushing and twisting operation, and a lock mechanism for locking a connection between the pair of members by fitting a pin in a hole provided in an elastic member, wherein connecting motion of the bayonet connection mechanism synchronizes with locking motion of the lock mechanism so that connection of the filter and locking of the connection are carried out simultaneously when the filter is connected to the face piece, while unlocking motion of the lock mechanism precedes disconnecting motion of the bayonet connection mechanism so that unlocking of the connection precedes disconnection of the filter when the filter is disconnected from the face piece.

In the detachable connector of the present invention, unlocking motion of the lock mechanism precedes disconnecting motion of the bayonet connection mechanism when the filter is disconnected from the face piece. That is, disconnection operation of the filter from the face piece requires two releasing motions independent of each other. Thus, detaching of the filter from the face piece by accident or user error is effectively prevented.

In accordance with a preferred aspect of the present invention, the elastic member of the lock mechanism is a band shaped body fixed at opposite ends and provided with radially outward bulges near the opposite ends and the hole is located at the longitudinal middle of the band shaped body, and wherein the pin of the lock mechanism opposes one of the radially outward bulges of the band shaped body at an initial stage of connecting motion of the bayonet connection mechanism, moves relatively to the band shaped body to the longitudinal middle of the band shaped body synchronously with progress of the connecting motion of the bayonet connection mechanism, and fits in the hole of the band shaped body at the completion of the connecting motion of the bayonet connection mechanism, while the pin is released from the hole when the radially outward bulges near the opposite ends of the band shaped body are forced radially inward so that the longitudinal middle of the band shaped body projects radially outward.

It requires a rather complicated action to force the radially outward bulges near the opposite ends of the band shaped body radially inward so as to make the longitudinal middle of the band shaped body bulge radially outward, thereby releasing the pin from the hole. Therefore, the aforesaid action is not likely to occur by accident or user error. Thus, detaching of the filter from the face piece by accident or user error is effectively prevented.

In accordance with a preferred aspect of the present invention, the elastic member of the lock mechanism is attached to the filter and the pin of the lock mechanism is attached to the face piece.

In accordance with a preferred aspect of the present invention, the elastic member of the lock mechanism is attached to the face piece and the pin of the lock mechanism is attached to the filter.

Relative position relationship between the elastic member and the pin of the lock mechanism can be either of the two described above.

In accordance with the present invention, there is provided a face piece of a breathing apparatus comprising any one of the aforesaid detachable connectors.

In the face piece of a breathing apparatus of the present invention, detaching of the filter from the face piece by accident or user error is effectively prevented.

MODES FOR CARRYING OUT THE INVENTION

A detachable connector in accordance with a preferred embodiment of the present invention will be described.

Figure 1:
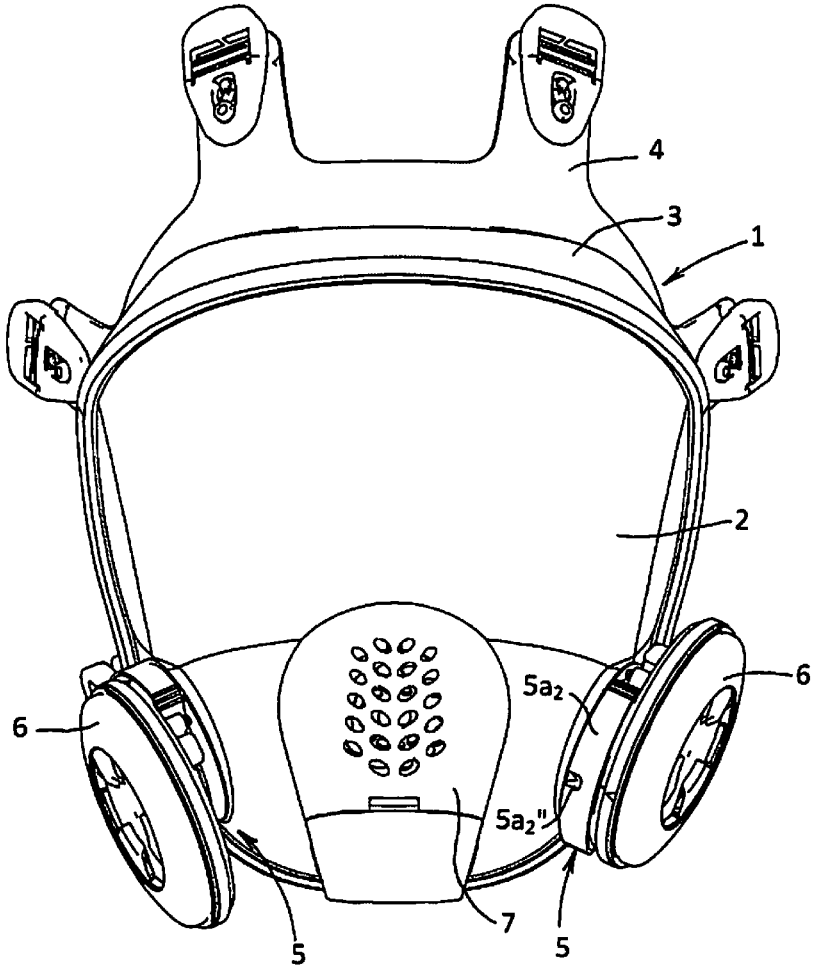
FIG. 1 is a front view of a full face piece comprising a detachable connector in accordance with a preferred embodiment of the present invention, shown at the start of the connecting operation of the filter.
Figure 3:
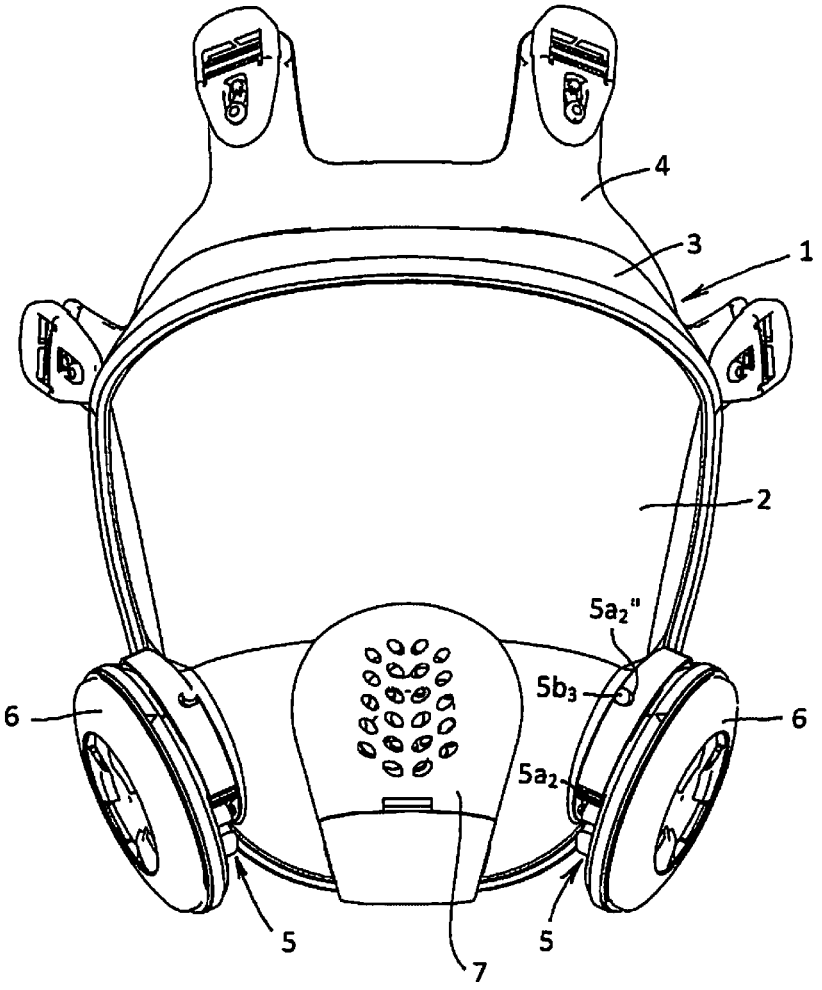
FIG. 3 is a front view of a full face piece comprising a detachable connector in accordance with a preferred embodiment of the present invention, shown at the completion of the connecting operation of the filter.

As shown in FIGS. 1 and 3, a full face piece 1 of a breathing apparatus comprises an visor 2 for covering a front part and both side parts of the face of a user of the breathing apparatus. The visor 2 is made of transparent hard plastic material. The full face piece 1 further comprises a main body 3 integrally united with a circumference of the visor 2 so as to cover a circumferential part of the face of the user. The main body 3 is made of flexible elastic material. The full face piece 1 further comprises fastening band connections 4 integrally formed with the main body 3, a pair of filters 6, each of which is connected to a lower side part of the visor 2 through a detachable connector 5, and a protection cover 7 connected to a lower front part of the visor 2 so as to protect an exhale valve and a voice conductor not shown in FIGS. 1 and 3. The fastening band connections 4 are connected to fastening bands for attaching the full face piece 1 to the head of the user. The fastening bands are not shown in FIGS. 1 and 3.

Figure 2:
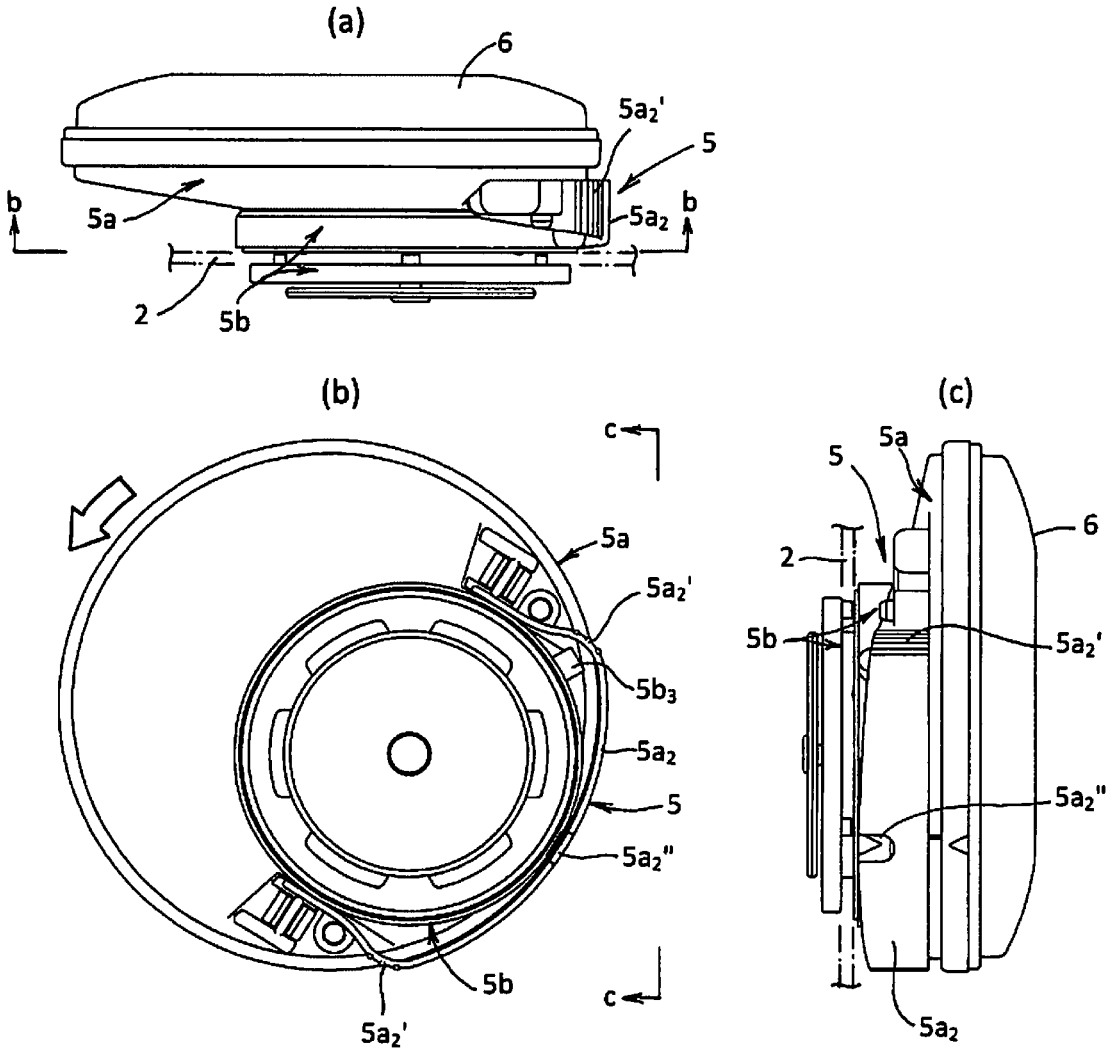
FIG. 2 is a set of views of external appearance of a detachable connector in accordance with a preferred embodiment of the present invention, shown at the start of the connecting operation of the filter. (a) is a side view, (b) is a view in the direction of arrows b-b in (a), and (c) is a view in the direction of arrows c-c in (b).
Figure 4:
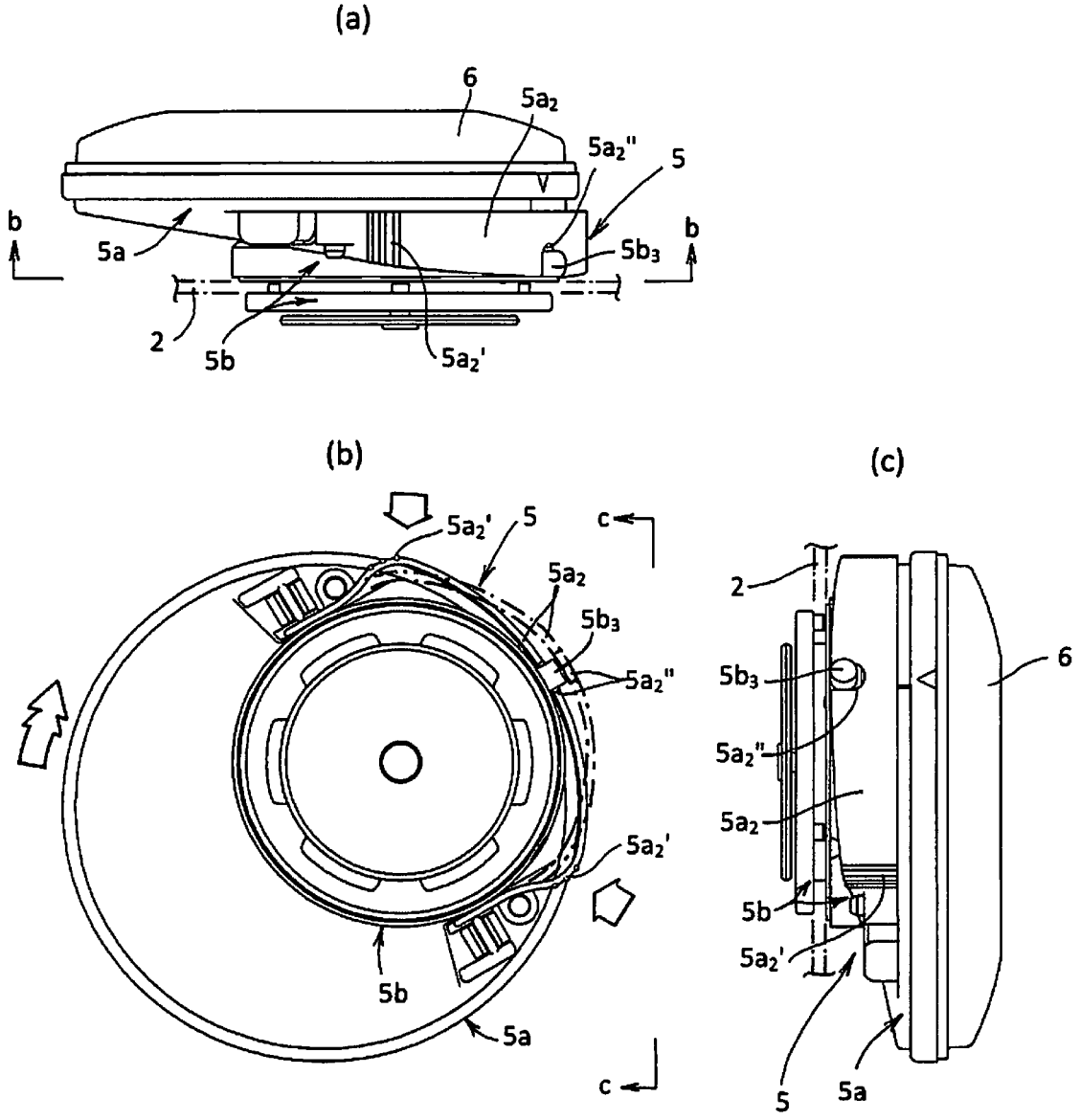
FIG. 4 is a set of views of external appearance of a detachable connector in accordance with a preferred embodiment of the present invention, shown at the completion of the connecting operation of the filter. (a) is a side view, (b) is a view in the direction of arrows b-b in (a) and (c) is a view in the direction of arrows c-c in (b).
Figure 5:
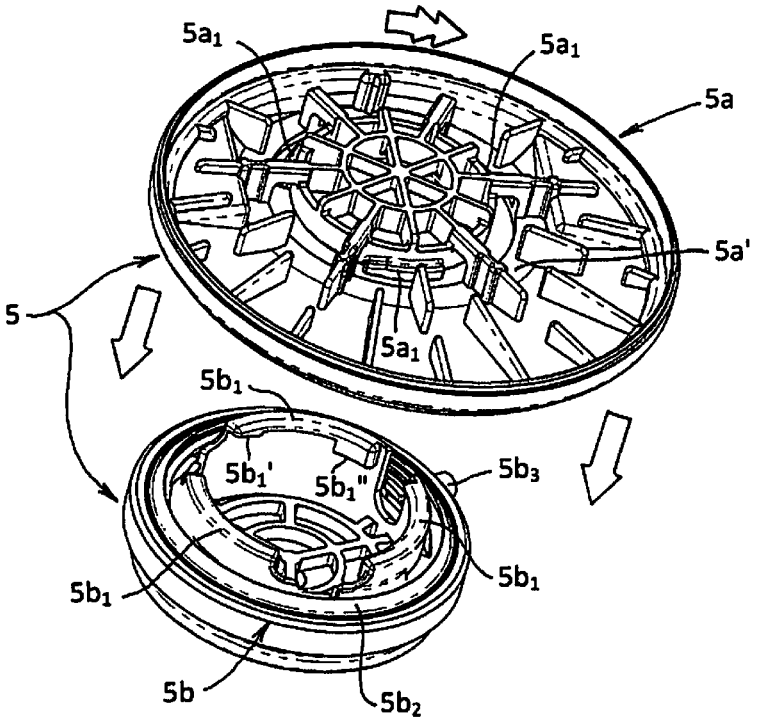
FIG. 5 is an exploded perspective view of a bayonet connection mechanism provided for a detachable connector in accordance with a preferred embodiment of the present invention, shown just before the start of the connecting operation of the filter.

As shown in FIGS. 2, 4 and 5, the detachable connector 5 comprises an annular shaped first part 5*a* forming a half body of a casing of the filter 6 close to the visor 2 and an annular shaped second part 5*b* integrally united with the visor 2.

The first part 5*a* comprises three lugs $\mathbf{5}a_1$ of a male part of a bayonet connection mechanism disposed at the center portion of the annular shape. The three lugs $\mathbf{5}a_1$ are disposed annularly and intermittently. The first part 5*a* further comprises an elastic member $\mathbf{5}a_2$ of a lock mechanism disposed radially outside the lugs $\mathbf{5}a_1$. The elastic member $\mathbf{5}a_2$ is a curved band shaped body made of elastic material which extends along the external circumferential surface of the second part 5*b* of the detachable connector 5 when the first part 5*a* and the second part 5*b* are connected to each other. The elastic member $\mathbf{5}a_2$ is fixed to the first part 5*a* of the detachable connector 5 at both longitudinal ends. The elastic member $\mathbf{5}a_2$ is provided with radially outward bulges $\mathbf{5}a_2'$ near the opposite ends and a hole $\mathbf{5}a_2''$ at the longitudinal middle. Radius of curvature of the radially outward bulges $\mathbf{5}a_2'$ is set smaller than that of the external circumference of the annular second part 5*b* of the detachable connector 5, while radius of curvature of a longitudinal middle part of the elastic member $\mathbf{5}a_2$ is set larger than that of the external circumference of the annular second part 5*b* of the detachable connector 5.

The second part 5*b* comprises three lugs $\mathbf{5}b_1$ of a female part of the bayonet connection mechanism disposed at the center portion of the annular shape. The three lugs $\mathbf{5}b_1$ are disposed annularly and intermittently. The second part 5*b* further comprises an annular shaped packing $\mathbf{5}b_2$ made of flexible elastic material and disposed radially outside the lugs $\mathbf{5}b_1$. The packing $\mathbf{5}b_2$ forms a spring. The second part 5*b* further comprises a pin $\mathbf{5}b_3$ of the lock mechanism disposed on the external circumferential surface. Each of the lugs $\mathbf{5}b_1$ is provided with a small projection $\mathbf{5}b_1'$ at one longitudinal end and a large projection $\mathbf{5}b_1''$ at the other longitudinal end. The projections $\mathbf{5}b_1'$ and $\mathbf{5}b_1''$ extend in the push-in direction of the male side member.

Operation of the detachable connector 5 will be described.

When a user of the breathing apparatus connects the filter 6 to the visor 2, the user holds the filter 6 in the hand, and as shown in FIG. 5, brings the three lugs $\mathbf{5}a_1$ of the male side member of the bayonet connection mechanism provided in the first part 5*a* opposite three annularly and intermittently disposed spaces between the three annularly and intermittently disposed lugs $\mathbf{5}b_1$ of the female side member of the bayonet connection mechanism provided in the second part 5*b*.

Then, the user moves the first part 5*a* in the direction indicated by blank arrows in FIG. 5 so as to abut an internal flat annular part 5*a*' of a bottom plate of the first part 5*a* against the annular packing $\mathbf{5}b_2$ of the bayonet connection mechanism provided in the second part 5*b*. The pin $\mathbf{5}b_3$ of the lock mechanism opposes one of the radially outward bulges $\mathbf{5}a_2'$ of the band shaped elastic member $\mathbf{5}a_2$ from radially inside with a radial space between them. Therefore, the pin $\mathbf{5}b_3$ does not obstruct approach of the first part 5*a* toward the second part 5*b*. The band shaped elastic member $\mathbf{5}a_2$ comes close to the external circumferential surface of the annular shaped second part 5*b* from radially outside at longitudinal middle.

Then, the user forces the first part 5*a* to abut the second part 5*b*, while compressing the annular packing $\mathbf{5}b_2$, so as to push the three lugs $\mathbf{5}a_1$ of the male side member of the bayonet connection mechanism into the three annularly and intermittently disposed spaces between the three annularly and intermittently disposed lugs $\mathbf{5}b_1$ of the female side member of the bayonet connection mechanism. Thus, the detachable connector 5 enters a state at the start of the connecting operation of the filter as shown in FIGS. 1 and 2. As aforesaid, the pin $\mathbf{5}b_3$ of the lock mechanism opposes one of the radially outward bulges $\mathbf{5}a_2'$ of the band shaped elastic member $\mathbf{5}a_2$ from radially inside with a radial space between them and the band shaped elastic member $\mathbf{5}a_2$ comes close to the external circumferential surface of the annular shaped second part 5*b* from radially outside at longitudinal middle.

Then, the user twists the first member 5*a* in the direction indicated by a blank double arrow in FIG. 5 and by a blank arrow in FIG. 2, while keeping the male side member of the bayonet connection mechanism at a position pushed into the female side member. The three lugs $\mathbf{5}a_1$ of the male side member pass over the small projections $\mathbf{5}b_1'$ of the three lugs $\mathbf{5}b_1$ of the female side member and move in the extending direction of the three lugs $\mathbf{5}b_1$ with upper surfaces opposite lower surfaces of the three lugs $\mathbf{5}b_1$ of the female side member when viewed in FIG. 5, collide with the large projections $5b_1$", and stop. The pin $5b_3$ of the lock mechanism moves together with the movement of the lugs $5a_1$ and relatively to the band shaped elastic member $5a_2$ toward the longitudinal middle of the band shaped elastic member $5a_2$, while expanding the band shaped elastic member $5a_2$ radially outward and reaches the hole $5a_2$". Thus, the detachable connector 5 enters a state at the completion of the connecting operation of the filter as shown in FIGS. 3 and 4. The pin $5b_3$ fits in the hole $5a_2$" at the longitudinal middle of the band shaped elastic member $5a_2$. When the user releases a hand from the filter 6, the three lugs $5a_1$ of the male side member are forced against the lower surfaces of the three lugs $5b_1$ of the female side member at upper surfaces when viewed in FIG. 5 under biasing force from the annular packing $5b_2$. Thus, the male side member and the female side member of the bayonet connection mechanism are connected to each other, the first part 5*a* and the second part 5*b* of the detachable connector 5 are connected to each other, and the filter 6 is connected to the visor 2. The pin $5b_3$ fits in the hole $5a_2$" at the longitudinal middle of the band shaped elastic member $5a_2$. Thus, connection between the first part 5*a* and the second part 5*b* of the detachable connector is locked and the connection of the filter 6 with the visor 2 is locked.

When the user wants to undo the connection between the filter 6 and the visor 2 so as to detach the filter 6 from the visor 2, the user, as shown in FIG. 4(*b*), pushes the radially outward bulges $5a_2$' near the opposite ends of the band shaped elastic body $5a_2$ radially inward as indicated by blank arrows so as to project the longitudinal middle of the band shaped body $5a_2$ radially outward as indicated by dashed line, thereby releasing the pin $5b_3$ from the hole $5a_2$" located at the longitudinal middle of the band shaped elastic body $5a_2$ so as to undo the lock of the connection between the first part 5*a* and the second part 5*b* of the detachable connector.

As aforesaid, each of the lugs $5b_1$ is provided with a small projection $5b_1$' extending in the push-in direction of the male side member at one longitudinal end. Therefore, even if the lock is released, the user cannot release the lugs $5a_1$ of the male side member of the bayonet connection mechanism from the lugs $5b_1$ of the female side member of the bayonet connection mechanism only by twisting the first part 5*a* comprising the male side member of the bayonet connection mechanism in the releasing direction.

Therefore, the user twists the first part 5*a* in the direction as indicated by a blank double arrow in FIG. 4(*b*), while pushing the radially outward bulges $5a_2$' near opposite of ends the band shaped elastic member $5a_2$ radially inward as indicated by blank arrows and pushing the first part 5*a* or the male side member of the bayonet connection mechanism toward the second part 5*b* or the female side member of the bayonet connection mechanism. The three lugs $5a_1$ of the male side member pass over the small projections $5b_1$' of the three lugs $5b_1$ of the female side member, move in the extending direction of the three lugs $5b_1$, and reach the three annularly and intermittently disposed spaces between the three annularly and intermittently disposed lugs $5b_1$ of the female side member of the bayonet connection mechanism. Then the user stops pushing the radially outward bulges $5a_2$' near the opposite ends of the band shaped elastic body $5a_2$ radially inward. As a result, connection between the male side member and the female side member of the bayonet connection mechanism is undone and the detachable connector returns to the state at the start of the connecting operation of the filter as shown in FIGS. 1 and 2.

Then, the user moves the first part 5*a* in the direction opposite to that indicated by the blank arrows in FIG. 5 so as to release the first part 5*a* from the second part 5*b*. As a result, the filter 6 is detached from the visor 2.

In the detachable connector 5, unlocking motion of the lock mechanism precedes disconnecting motion of the bayonet connection mechanism when the filter 6 is disconnected from the visor 2. That is, disconnection operation of the filter 6 from the visor 2 needs two releasing motions independent of each other. Thus, detaching of the filter 6 from the visor 2 by accident or user error is effectively prevented.

It requires a rather complicated action to force the radially outward bulges $5a_2$' near the opposite ends of the band shaped body $5a_2$ radially inward so as to make the longitudinal middle of the band shaped body $5a_2$ project radially outward, thereby releasing the pin $5b_3$ from the hole $5a_2$". Therefore, the aforesaid procedure is not likely to occur by accident or user error. Thus, detaching of the filter 6 from the visor 2 by accident or user error is effectively prevented.

As a result, detaching of the filter 6 from the visor 2 by accident or user error is effectively prevented in the full face piece 1 of the breathing apparatus.

In the aforesaid preferred embodiment, the band shaped elastic member $5a_2$ of the lock mechanism is attached to the filter 6 and the pin $5b_3$ of the lock mechanism is attached to the visor 2 of the face piece. It is possible instead to attach the band shaped elastic member $5a_2$ of the lock mechanism to the visor 2 of the face piece and attach the pin $5b_3$ of the lock mechanism to the filter 6.

The face piece for which the detachable connector 5 is used is not restricted to the full face piece. The detachable connector 5 can be used for a half face piece which covers only the user's mouth and nose.

INDUSTRIAL APPLICABILITY OF THE INVENTION

The present invention can be widely used for a detachable connector between a face piece and a filter of a breathing apparatus comprising a bayonet connection mechanism for connecting a pair of members by pushing and twisting operation.

EXPLANATION OF REFERENCE NUMERALS

1 Full face piece
2 Visor
3 Main body
4 Fastening band connection
5 Detachable connector
5*a* First part
$5a_1$ Lug of male side member of bayonet connection mechanism
$5a_2$ Band shaped elastic member
$5a_2$' Radially outward bulge
$5a_2$" Hole
5*b* Second part
$5b_1$ Lug of female side member of bayonet connection mechanism
$5b_1$' Small projection
$5b_1$" Large projection
$5b_2$ Packing of bayonet connection mechanism
$5b_3$ Pin
6 Filter
7 Protection cover

The invention claimed is:

1. A detachable connector between a face piece and a filter of a breathing apparatus, comprising:

a bayonet connection mechanism disposed to connect a pair of members by a pushing and twisting operation; and a lock mechanism disposed to lock a connection between the pair of members by fitting a pin in a hole provided in an elastic member;

wherein a connecting motion of the bayonet connection mechanism synchronizes with a locking motion of the lock mechanism so that connection of the filter and locking of the connection are carried out simultaneously when the filter is connected to the face piece;

wherein an unlocking motion of the lock mechanism precedes disconnecting motion of the bayonet connection mechanism so that unlocking of the connection precedes disconnection of the filter when the filter is disconnected from the face piece;

wherein the elastic member of the lock mechanism is a band shaped body fixed at opposite ends and provided with a pair of radially outward bulges near the opposite ends and the hole is located at the longitudinal middle of the band shaped body, and wherein the pin of the lock mechanism opposes one of the radially outward bulges of the band shaped body at an initial stage of connecting motion of the bayonet connection mechanism, moves relatively to the band shaped body to longitudinal middle of the band shaped body synchronously with progress of the connecting motion of the bayonet connection mechanism, and fits in the hole of the band shaped body at the completion of the connecting motion of the bayonet connection mechanism, while the pin is released from the hole when the radially outward bulges near the opposite ends of the band shaped body are forced radially inward so that the longitudinal middle of the band shaped body projects radially outward.

2. A detachable connector of claim 1, wherein the elastic member of the lock mechanism is attached to the filter and the pin of the lock mechanism is attached to the face piece.

3. A detachable connector of claim 1, wherein the elastic member of the lock mechanism is attached to the face piece and the pin of the lock mechanism is attached to the filter.

4. A face piece of a breathing apparatus comprising a detachable connector of claim 1.

* * * * *